US006029575A

United States Patent [19]

Bischer

[11] Patent Number: 6,029,575

[45] Date of Patent: Feb. 29, 2000

[54] DEVICE FOR CLEANING A CYLINDER IN A PRINTING PRESS

[75] Inventor: Mathias Bischer, Bürstadt, Germany

[73] Assignee: Heidelberger Druckmaschinen AG, Heidelberg, Germany

[21] Appl. No.: 09/201,985

[22] Filed: Dec. 1, 1998

[30] Foreign Application Priority Data

Dec. 1, 1997 [DE] Germany ..... 197 53 231

[51] Int. Cl.[7] ..... B41F 35/00

[52] U.S. Cl. ..... 101/425; 101/424

[58] Field of Search ..... 101/425, 424, 101/423; 15/256.52, 256.51, 256.5, 256.53

[56] References Cited

U.S. PATENT DOCUMENTS 4,875,412 10/1989 Wright et al. ..... 101/423
5,575,211 11/1996 Harrison ..... 101/423
5,615,612 4/1997 Guba et al. ..... 101/423
5,870,954 2/1999 Lovenstein et al. ..... 101/423

FOREIGN PATENT DOCUMENTS 0 659 560 A1 6/1995 European Pat. Off. .
37 44 800 A1 6/1989 Germany .

*Primary Examiner*—Ren Yan
*Assistant Examiner*—Anthony H. Nguyen
*Attorney, Agent, or Firm*—Herbert L. Lerner; Laurence A. Greenberg

[57] ABSTRACT

A device for cleaning a cylinder in a printing press, having a cleaner engageable and disengageable with the cylinder, the cleaner being disposed in a housing formed with an opening, includes a device for closing the opening of the housing, the closing device being actuatable for moving the housing relative to a covering so as to bring the opening of the housing into alignment with the covering.

15 Claims, 6 Drawing Sheets

DEVICE FOR CLEANING A CYLINDER IN A PRINTING PRESS

BACKGROUND OF THE INVENTION

1. Field of the Invention:

The invention relates to a device for cleaning a cylinder in a printing press, having a cleaner, in particular a cleaning roller engageable and disengageable with the cylinder, the cleaning roller being disposed in a housing formed with an opening.

Devices of this general type enable self-cleaning of the cleaner in the housing, which shortens the time for cleaning the cylinder. Furthermore, it is possible to prevent the cleaning agent from evaporating into the print room, and the cleaner from drying out. In the case of a brush roller, the self-cleaning of the cleaner is performed by feeding a cleaning fluid or water to the brush roller within the housing which has been sealed off, and thereafter wiping or stripping away the cleaning fluid or the water together with the contaminants from the bristles with a doctor blade. The cleaner can also be cleaned by blown or blast air which blows the contaminants out.

The published European Patent Document EP 0 659 560 B1 contains a description of a cleaning device for cylinders of printing presses, a housing for the cleaning device having at least one additional movable housing part, which exposes the opening in the engaged position of the cleaning device and/or closes the opening in the disengaged position of the cleaning device.

Although this heretoforeknown device enables self-cleaning of the cleaner, it is of complicated construction and susceptible to failure. The movable housing part has to be guided in guides. The guides may become jammed due to an accumulation of printing ink residues, paper dust or the like. This problem exists, in particular, for very accurately produced guides which are simultaneously intended to have a sealing function. However, sealing measures separate from the guide and intended to seal off the parts also call for an increased production outlay or expense. The opening and closing of the opening via resilient springs is likewise unreliable and may lead, in the case of an incomplete opening, for example, to damage to the outer cylindrical or casing surface of the cylinder to be cleaned and to the cleaning device.

Starting from the prior art, it is an object of the invention to provide a cylinder-cleaning device which is of relatively simple and straightforward construction and which functions reliably.

SUMMARY OF THE INVENTION

With the foregoing and other objects in view, there is provided, in accordance with the invention, a device for cleaning a cylinder in a printing press, having a cleaner engageable and disengageable with the cylinder, the cleaner being disposed in a housing formed with an opening, comprising a device for closing the opening of the housing, the closing device being actuatable for moving the housing relative to a covering so as to bring the opening of the housing into alignment with the covering.

In accordance with another feature of the invention, the opening of the housing is directed towards the cylinder when the cleaner is in an in-contact position, and the opening is essentially directed away from the cylinder when the cleaner is in an out-of-contact position.

In accordance with a further feature of the invention, the opening of the housing is directed towards a trough disposed beneath the housing when the cleaner is in the out-of-contact position, the trough serving as the covering.

In accordance with an added feature of the invention, the trough is connected to the housing so that, during a movement of the housing towards and away from the cylinder, the trough is entrained by the housing.

In accordance with an additional feature of the invention, the housing is formed so as to be rotatable or swivelable about an axis parallel to the axis of rotation of the cylinder.

In accordance with yet another feature of the invention, the housing and the cleaner are coaxially rotatably mounted.

In accordance with yet a further feature of the invention, the housing opening is forcibly closed by the closing device as the cleaner moves out of contact with the cylinder, and opened as the cleaner moves into contact with the cylinder.

In accordance with yet an added feature of the invention, the closing device comprises a gear transmission mechanism for forcibly closing and opening the housing opening as the cleaner moves into and out of contact with the cylinder.

In accordance with yet an additional feature of the invention, the gear transmission mechanism is a cross-slider crank mechanism.

In accordance with still another feature of the invention, the cleaner is formed as a brush roller, and at least one cleaning element is assigned to the brush roller inside the housing.

In accordance with still a further feature of the invention, the cleaning element disposed inside the housing is separate therefrom.

In accordance with still an added feature of the invention, the cleaning element is a combined spraying and cleaning doctor blade for penetrating into bristles of the brush roller.

In accordance with still an additional feature of the invention, the cleaning device is in combination with a printing press, in particular a sheet-fed offset printing press.

In accordance with another feature of the invention, the cleaner is a cleaning roller.

In accordance with a concomitant feature of the invention, the cleaner is a roller-type cleaner having an axis of rotation, and the housing is rotatable about the axis of rotation of the roller-type cleaner.

Thus, the device for cleaning a cylinder in a printing press, having a cleaner, in particular a cleaning roller, which can be brought into and out of contact with the cylinder and is arranged in a housing having an opening, is distinguished by the fact that the housing is formed so that it can be closed by a device which moves the housing relative to a covering, the opening being brought into alignment with the covering by the closing device.

An essential feature of the invention is that the housing can be closed by being moved, in particular rotated, the closure being understood as meaning hereinbelow both a completely sealing closure and incomplete sealing with an adequate spray protection function. In the case wherein the housing is closed by a rotary or swiveling movement, for example, the size of the angle through which the opening is swiveled or rotated from a first position wherein it is directed towards the cylinder, into a second position wherein it is directed away from the cylinder, follows from the respective specific configuration and size of the opening. In any case, reliable protection against spray must be provided.

It was found that a closable device does not need any other movable housing part in addition to the housing and, in particular, does not need a plurality of additional movable housing parts such as are proposed in the published European Patent Document EP 0 659 560 B1. Many advantages may be achieved based upon this finding.

In order to move the housing, relatively simply constructed devices can be used, so that the outlay for or expense of production is kept low, while absolutely reliable functioning is maintained. The covering towards which the opening of the housing is directed, may possibly be a part which is already present in the printing press, for example a wall of the printing press, or a part which is specially provided for this purpose. The housing and the opening therein can be rotated, pivoted, swiveled or displaced relative to the covering, the opening being directed towards the covering. For example, the housing can be displaced rectilinearly along a tangential plane of the cylinder, the opening being covered by a covering that extends in the tangential plane.

In an advantageous embodiment, when the cleaner is in an in-contact or engaged position, the opening is directed towards the cylinder, and when the cleaner is in an out-of-contact or disengaged position, the opening is essentially directed away from the cylinder. In this manner, the cylinder, and in particular printed material which may be conveyed on the cylinder, are assured of optimum spray protection against the cleaning agent which is sprayed in the housing in the course of the self-cleaning process of the cleaner during the printing operation.

In a preferred embodiment, when the cleaner is in the out-of-contact position, the opening is directed towards a trough which is arranged underneath the housing and, in this case, functions as the covering. By a trough there is meant a run-off surface or a collecting tank. Such elements are often present in any case and serve to protect those press parts, which are located under the cleaner, against cleaning agents which continue to drip, and serve for storage and feedback of the cleaning agents. A particularly favorable factor with regard to this embodiment is that the cleaning agent that accumulates on the housing inner walls during the self-cleaning process of the cleaner can run off completely from the walls into the trough. The trough and the housing may be configured so as to be adapted to one another in such a way that effective protection against spray is provided in the in-contact and out-of-contact positions, i.e., during cylinder cleaning and self-cleaning.

A trough which is fastened in a locally fixed or stationary manner, for example to the press frame, may extend over the length of the in-contact and out-of-contact path, so that there is drip protection in any position of the cleaner.

In another embodiment, the trough may be movable, it being connected to the housing, for example via a gear transmission mechanism, so that the trough is entrained with a movement of the housing towards and away from the cylinder. In this regard, it is advantageous for the housing to be better able to cover the trough, which is filled, for example, with spent cleaning agent, so that the evaporation of the cleaning agent from the trough is reduced. The edges of the trough may overlap the outer wall of the housing in the region of the opening when the cleaner is in the out-of-contact position, so that good sealing is achieved.

The housing may be constructed so as to be rotatable or swivelable about an axis parallel to the axis of rotation of the cylinder to be cleaned. This mobility of the housing permits the cleaning device according to the invention to be accommodated in a very small amount of space. Particularly favorable installation conditions are achieved if the housing is constructed to be rotatable about an axis of rotation of a roller-type cleaner.

In a further embodiment, the device moving the housing forcibly closes the housing or the opening therein as the cleaner moves out of contact with the cylinder and opens the housing or the opening therein as the cleaner moves into contact with the cylinder. One advantage of this embodiment is that, in addition to an actuating drive for moving the cleaner into and out of contact with the cylinder, there is no need for any further drive for closing the housing, for example for rotating the latter. As an alternative thereto, in specific applications, it is possible for a further drive for closing the housing and, for example, for mutually coordinated control of the two drives to be provided. Electric motors, hydraulic cylinders or preferably pneumatic cylinders can be used as suitable drives for moving the cleaner into and out of contact with the cylinder and for closing the housing or the opening therein.

The device which moves the housing may comprise a gear transmission mechanism, preferably in the form of a link mechanism, for forcibly coupling the closing and the opening of the housing with the movement into and out of contact with the cylinder. A construction of the link mechanism as a cross-slider crank mechanism is particularly favorable. A cross-slider crank mechanism of this type comprises two adjacent links that are formed as thrust links. The thrust links may be constructed, for example, in the form of a first groove and a first groove block engaging in the latter, and a second groove and a second groove block engaging in the latter, the first groove serving for the movement of the cleaner and of the housing into and out of contact with the cylinder, and the second groove serving to rotate the housing.

A grooved cam gear mechanism constructed in this manner ensures the highest functional reliability with the simplest construction. In every case, moving the cleaner into contact with the cylinder forcibly opens the housing or the opening therein, so that jamming is virtually eliminated. Due to the fact that the grooves or slots are of rectilinear form and are machined into the frame, the outlay or expense for production can be minimized. The groove blocks may be formed cuboidal, or may be similar to conventional T-groove blocks or preferably round, for example formed like pins or bolts. The fact that such a gear transmission mechanism is arranged on both sides of the housing permits the requirements relating to the stability and, in particular, to the torsional rigidity of the housing to be reduced, so that the housing may be of lightweight construction.

In a further embodiment, the housing and the cleaner are coaxially rotatably mounted. This measure permits retrofitting or subsequent installation of the cleaning device in machines wherein installation conditions are unfavorable due to inadequate space, and contributes to the simplification of the housing construction. This embodiment may be implemented favorably by the first groove block being arranged on the housing and enclosing a journal pin which forms the axis of rotation of the cleaner, in particular a roller-type cleaner. The cleaning time may be shortened in many cases, for example in the case of cleaning a blanket cylinder, an impression cylinder or a sheet transfer drum in an offset printing press, by using a brush roller as the cleaner. This brush roller is rotatably driven and may oscillate in a lateral direction. If the cylinder and the cleaning roller rotate in the same direction, the outer surface of the cleaning roller, for example the bristles or, instead of the latter, a fleece-like or textile covering, and the outer cylindrical or jacket surface of the cylinder to be cleaned move relative to one another in opposite directions, with a particularly thorough cleaning action. Inside the housing, the brush roller may have at least one cleaning element assigned thereto, which is loose or arranged separate from the housing. The cleaning element may preferably be a combined spraying and cleaning doctor blade which penetrates into the bristles of the brush, or a conventional doctor blade or a cleaning-agent feeder. A combined spraying and cleaning doctor blade has, inter alia, the advantage that a cleaning fluid and/or water, rather than being just applied to the surface formed by the bristles located closely alongside one another and being thrown out into the housing again as a result of the rotation of the roller, is injected into bristle regions of the brush which are located farther in. A detailed description of the functioning of the combined spraying and cleaning doctor blade, which is known per se, and further advantages which are associated with the use thereof, in particular the washing-out effect, are described in U.S. Pat. No. 5,035,178 which, in this regard, are to be included as reference documents. Going beyond this, however, it was found that, in addition to thorough cleaning of the cylinder, very effective self-cleaning of a brush roller, in particular within an essentially sealed-off housing, may be achieved using a combined spraying and cleaning doctor blade of this type. This is because, in the case of the self-cleaning of the brush roller, deep penetration of the liquids into the bristle assembly or filling is favorable for detaching contaminants that have accumulated close to and on the brush-roller core carrying the bristles. In the case of conventional spray nozzles, the cleaning fluid, particularly in the case of bristles that are located very closely alongside one another, is often thrown out again by centrifugal force before it passes into the regions of the bristles which are located at the bottom. As a result of the cleaning elements being arranged separate from the housing, for example being fastened to the frame of the machine, particularly smooth-running rotation of the housing may be made possible. In many cases, the cleaning elements may also be arranged on or fastened to the housing.

Other features which are considered as characteristic for the invention are set forth in the appended claims.

Although the invention is illustrated and described herein as embodied in a device for cleaning a cylinder in a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
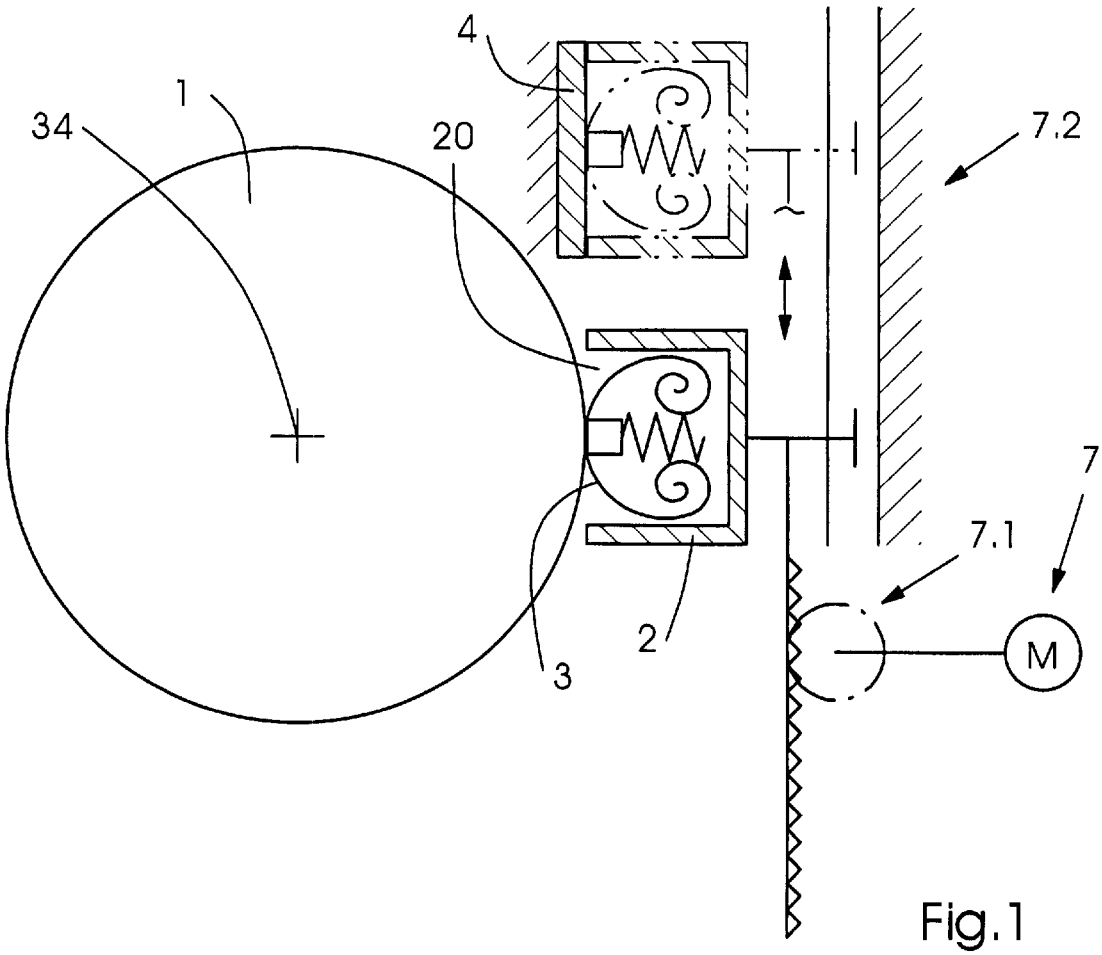
FIG. 1 a schematic and diagrammatic side elevational view, partly in section, of an embodiment of the cleaning device according to the invention having a displaceable housing.

Mutually corresponding parts are provided with identical reference characters in the figures.

Referring now more particularly to the figures of the drawings, there is shown in FIG. 1 thereof a device for cleaning a cylinder of a printing press in accordance with the invention. A cleaner 3 is formed as a windable and unwindable cloth which is guided over a pressure element, and is disposed in the housing 2. The housing 2 can be closed when it is moved by a device 7, 7.1, 7.2 relative to a covering 4, which is fixed to the printing press, so that the covering 4 covers the opening 20. The movement is performed under the guidance of a guide 7.2, for example the illustrated linear guide, and is driven by an actuating drive 7. The actuating drive 7 moves the housing 2 via a gear transmission mechanism 7.1, which may be formed, as shown, as a rack and pinion gear. The actuating drive 7 may be an electric motor. In this embodiment, the movement of the cleaner 3 into and out of contact with the cylinder and, together therewith, the movement of the housing 2 toward the covering 4, take place in the tangential direction which extends perpendicularly to the radial direction of action of the cleaner 3 relative to the cylinder 1 and perpendicular to the axis of rotation 34. The movement of the housing 2 which is to be closed may also take place in the direction of the axis of rotation 34 along the outer surface of the cylinder 1.

Figure 2:
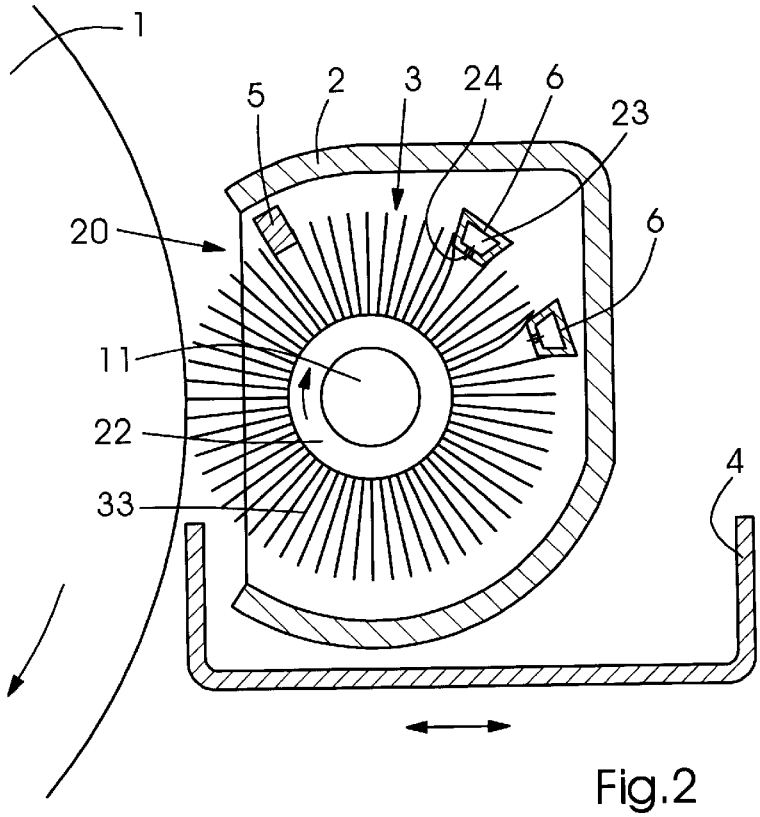
FIG. 2 is a schematic and diagrammatic side elevational view, partly in section, of another embodiment of the cleaning device having a rotatable housing, disposed in a cleaning position thereof.

FIG. 2 shows a preferred, further embodiment of the cleaning device according to the invention, which is disposed in an engaged, in-contact or cleaning position, wherein the cleaner 3, which is formed as a brush roller, is brought into contact with the outer surface of the cylinder 1. Except for the opening 20, the housing 2 surrounds or encloses the cleaner 3 completely in the circumferential direction of the cleaner 3, that is to say at least on three sides. Recesses can be formed in any side wall of the housing 2 for the cleaning elements 5 and 6, which are disposed separate from the housing 2, and for journals 11. The cleaning elements 5 and 6 include at least one wiper or doctor blade 5 and a feeder device 6 for a cleaning fluid and/or water. The housing 2 may, however, also be formed so as to be open on one or both sides. Side walls may easily be dispensed with, in particular, when the housing 2 is sufficiently wider than the cleaner 3, so that the housing 2 extends far beyond the ends 22, for example, and drying of the cleaner 3 and emission of cleaning agents are not an issue. In this case, the fact that the housing 2 projects laterally beyond the cleaner 3 to a sufficient extent prevents the cleaning fluid or the water from spraying laterally out of the housing 2. The cleaning elements 5 and 6 may be formed as a doctor blade 5 and as a combined spraying and cleaning doctor blade 6. The cylinder 1 is cleaned with the cleaner 3 while a cleaning fluid and/or water is fed in via at least one of the combined spraying and cleaning doctor blades 6. The cleaning cycle may include several cleaning operations, it being possible for the cylinder 1 to be washed with a cleaning fluid in a first cleaning operation and rewashed with water in a subsequent second cleaning operation. After the first cleaning operation, for cleaning the cylinder 1 using the cleaning fluid, self-cleaning of the cleaner 3 can take place, for which purpose preferably only water is fed to the cleaner 3, so that the cleaner 3 has a very low content of cleaning fluid when it is used during the subsequent second cleaning operation in order to clean the cylinder 1 with this rinsing water. It is preferable if one of two combined spraying and cleaning doctor blades 6 is used to feed the cleaning fluid and the other spraying and cleaning doctor blade 6 is used to feed the water. As viewed in the direction of rotation of the cleaner 3, a further doctor blade 5 is disposed upline of the combined spraying and cleaning doctor blades 6. By this arrangement, the contaminants will have in substance already been wiped or stripped off by the doctor blade 5, when fresh cleaning fluid or water is introduced by the combined spraying and cleaning doctor blade 6 onto the cleaner 3 and into the assembly of bristles thereon, respectively. The combined spraying and cleaning doctor blades 6 are formed as hollow-profile bars, branches 24, which open into outlet openings, branching off from a longitudinal channel 23 and preferably being aligned radially relative to the cleaner 3. The cleaning elements 5 and 6 may have a polygonal, for example trapezoidal, cross section or may be of round or tubular shape. The geometry which is most favorable for an optimum cleaning effect should be selected depending upon the nature of the bristles 33 and the arrangement of the cleaning elements 5 and 6. Furthermore, a cleaning element 5, 6 may also be formed as an air knife that blows out contaminants, for example paper particles, which have accumulated deep within the bristle assembly or filling. Of course, rather then being formed as a doctor blade which penetrates into the cleaner 3, it is also possible for a cleaning element 5, 6 that can be supplied with the cleaning fluid, the water or the blown air to be formed as a feeder that operates without contact with the cleaner 3, for example a nozzle bar.

Figure 3:
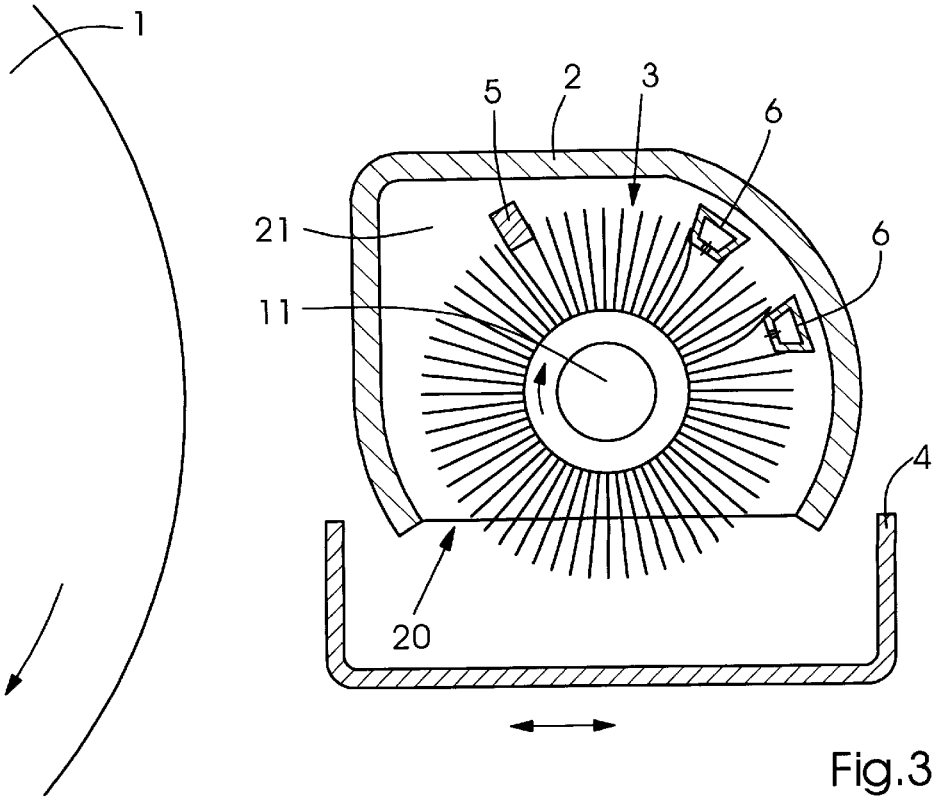
FIG. 3 is another view like that of FIG. 2 showing the cleaning device in another operating phase wherein the rotatable housing is in a rest position thereof.

In FIG. 3, the device of FIG. 2 is shown in disengaged or out-of-contact position, that is to say without any contact between the cleaner 3 and the cylinder 1, the cleaner 3 resting or being cleaned in the out-of-contact position. As viewed from the side, in this position, the combined spraying and cleaning doctor blade 6 is located in a first quadrant, and the doctor blade 5 in a second quadrant, so that the contaminants that are stripped or wiped off during the self-cleaning process are thrown out essentially against the inner housing walls and possibly to some extent into the trough, but not out of the opening 20. In the case of a device having cleaning elements 5 and 6 that are separate from the housing 2, the aforedescribed advantageous position of the cleaning elements 5 and 6, as shown in FIG. 2, is also provided in the engaged or in-contact position.

During the self-cleaning process of the cleaner 3, the latter is rotatingly driven by a drive (FIG. 7) that is separate from the drive of the printing press, so that the cleaner 3 can be cleaned while the printing press is printing. During this process, the cleaner 3 is fed with the cleaning fluid and/or preferably water individually or together, as required, via feeders, for example the combined spraying and cleaning doctor blades 6. It is preferable if, as viewed in the direction of rotation of the cleaner, the feeders for the water are arranged before the feeders for the cleaning fluid. During the self-cleaning process, the cleaner 3 preferably rotates in the illustrated direction of rotation. One or more reversals in the direction of rotation may also be expedient in specific cases. Due to the rotation, ink and paper residues are wiped or stripped off the bristles by the doctor blade 5 and the combined spraying and cleaning doctor blade 6 and are thrown off by the bristles as they return to the starting position thereof after they have been relieved of load.

Figure 4:
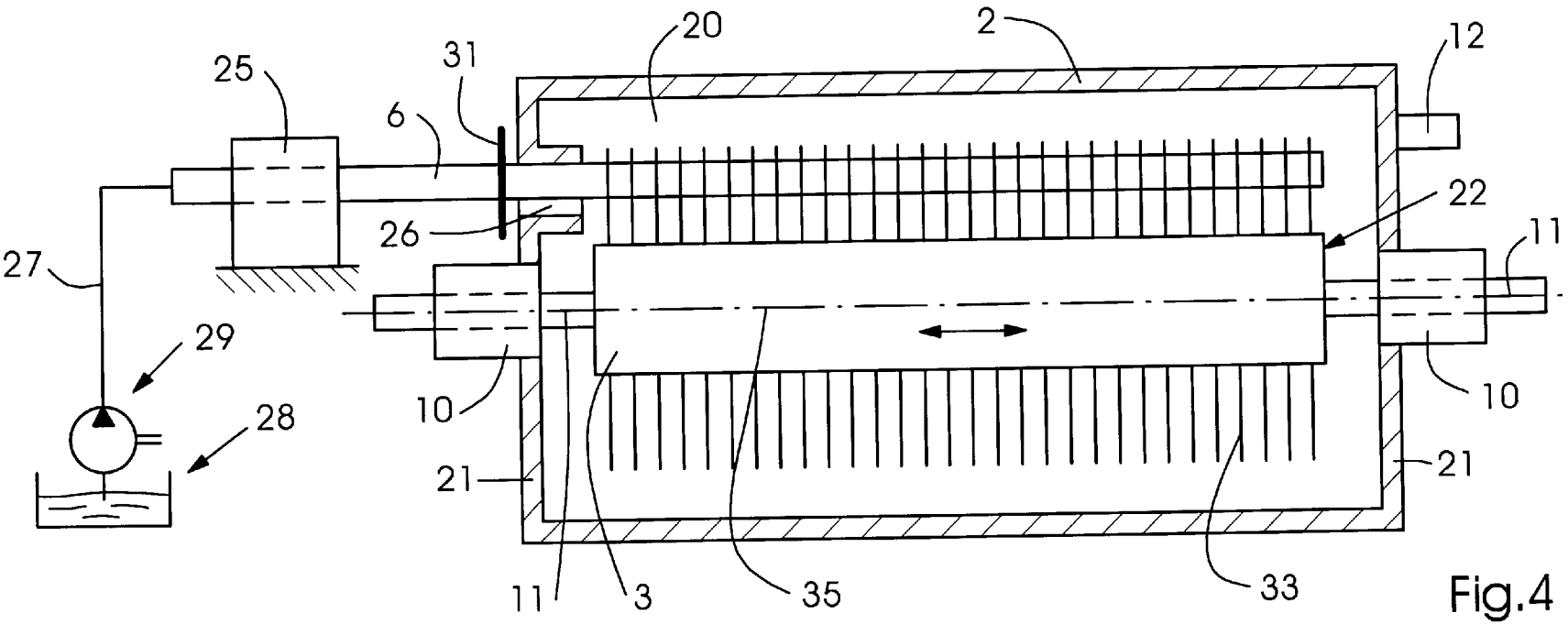
FIG. 4 is a front elevational view of FIG. 2, with the cylinder removed.

In FIG. 4, the device illustrated in FIG. 2 is shown, partly in section, in a front elevational view. In the interest of clarity, the trough has not been illustrated. This figure shows that the cleaning elements 5 and 6, which are disposed separate from the housing 2, for example on a frame 25, may be introduced through a side wall 21 into the interior of the housing 2 through side cut-outs 26, for example arcuate slots which extend coaxially with the axis of rotation of the laterally oscillating cleaner 3 and the housing 2. In many cases, one or both side walls 21 can be omitted, so that cut-outs 26 of this type are not required. With the aid of a pump 29, water or cleaning fluid is led from a reservoir 28, through a line 27, to the cleaning element 6, which is formed as a combined spraying and cleaning doctor blade.

Figure 5:
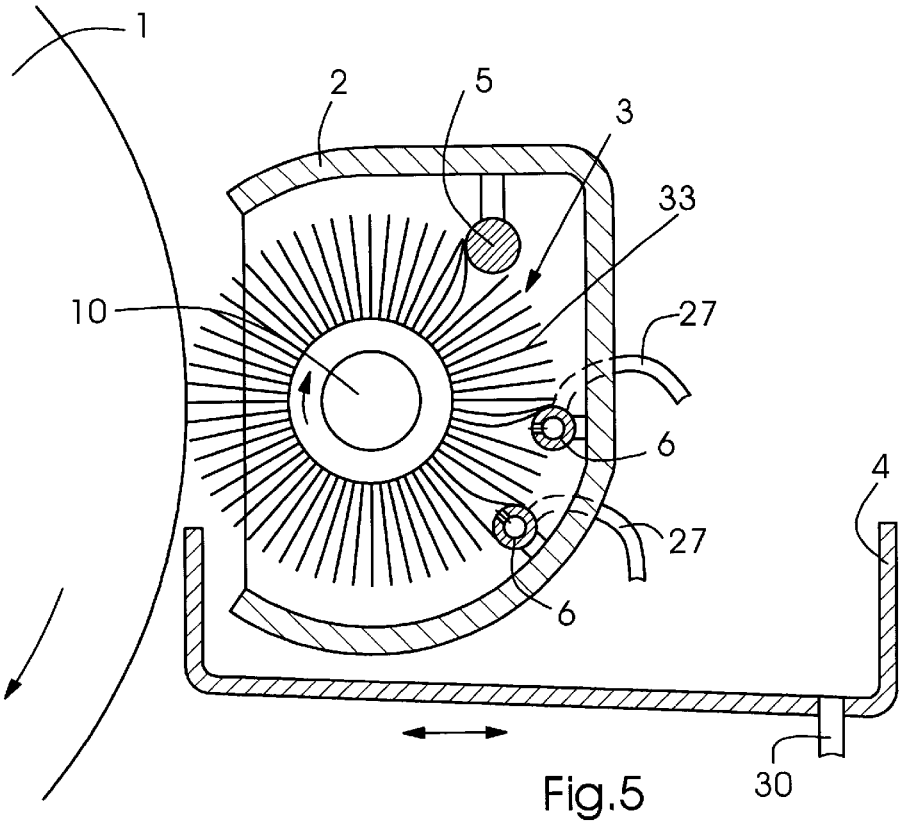
FIG. 5 is a view like that of FIG. 2 of a further embodiment of the cleaning device with the rotatable housing disposed in the cleaning position thereof.
Figure 6:
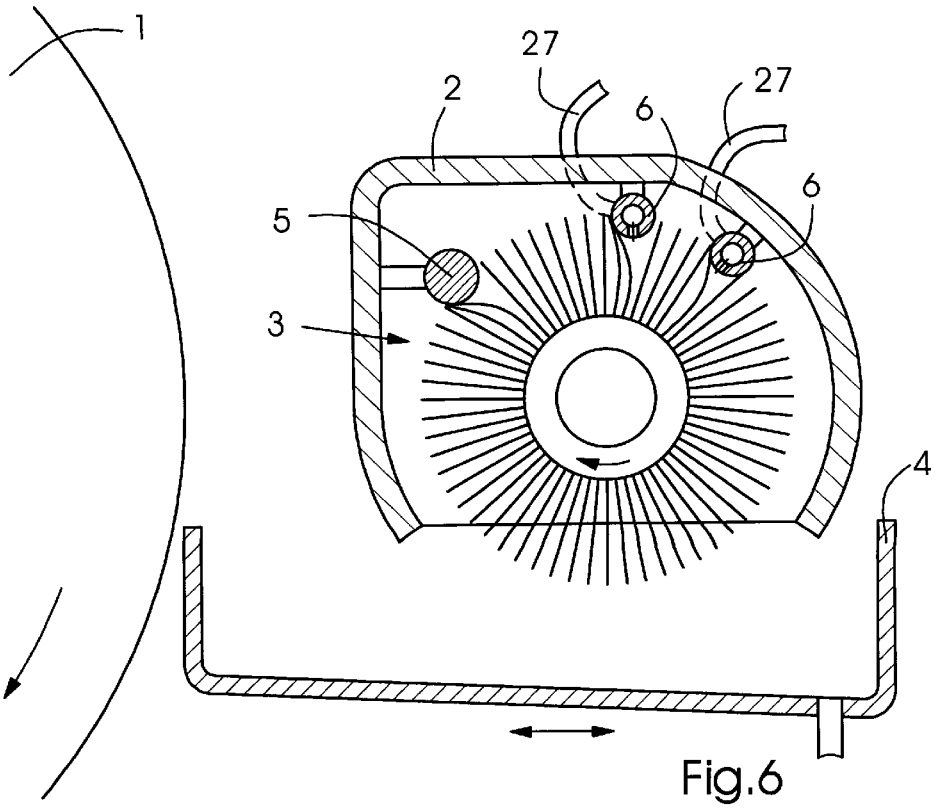
FIG. 6 is a view like that of FIG. 3 of the further embodiment of the cleaning device of FIG. 5 with the rotatable housing disposed in the rest position thereof.

In FIGS. 5 and 6, a further embodiment of the cleaning device according to the invention is shown in the engaged or in-contact position (FIG. 5) and in the disengaged or out-of-contact position (FIG. 6), this embodiment of the cleaning device differing from those previously described, on the one hand, in that the cleaning elements 5 and 6 are arranged on the housing 2 and are entrained or moved with the latter during the rotation thereof. In this case, it is expedient to form and support the housing 2 sturdily, and to form the lines 27 for the cleaning fluid and/or water feed to the illustrated combined spraying and cleaning doctor blades 6, or else to nozzle bars, as flexible hoses. This embodiment of the cleaning device differs from those described hereinbefore, on the other hand, by the stationary arrangement of the trough 4. The trough 4 extends over the entire adjustment path, so that liquid running out of the housing 2 is reliably intercepted both in the engaged or in-contact position, and in the disengaged or out-of-contact position. The trough 4 may be inclined and may have a discharge outlet 30. The cleaning elements 5 and 6 have a round shape, due to which particularly uniform wiping of the bristles 33 on the elements is achieved and accumulation of contaminants behind corners and edges is avoided. When forming the housing 2, care should be taken that, in the position shown in FIG. 5, it is not possible for so much liquid to accumulate in the bottom housing wall which forms a concave shell, that the cleaner 3 dips into the latter and splashes or sprays the housing. By appropriately inclining these wall surfaces and discharges, it is possible to ensure, in a relatively simple manner, that the liquid runs out of the housing 2 into the trough 4 even in this position.

Figure 7:
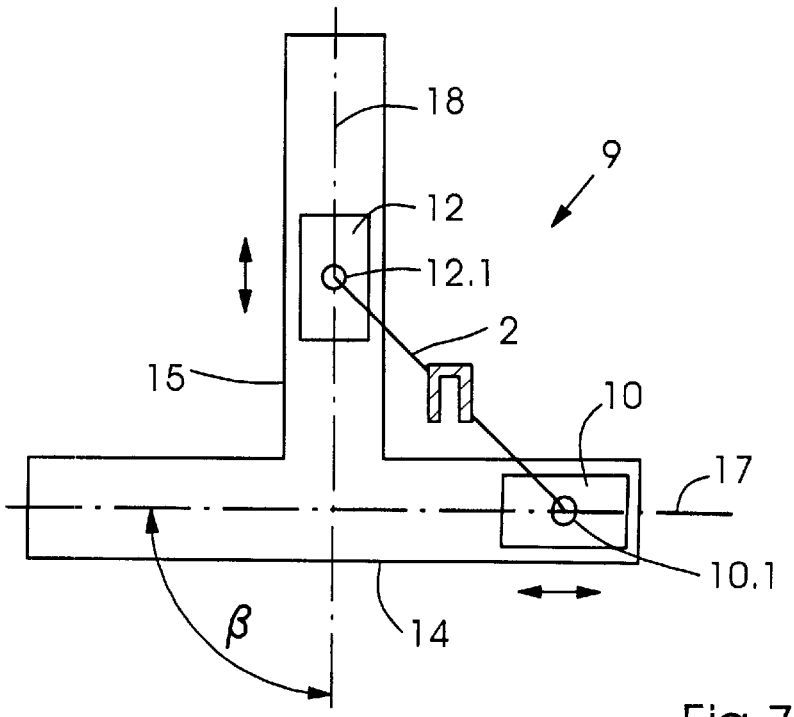
FIG. 7 is a schematic diagram of a gear transmission of the cleaning device according to the invention.

FIG. 7 is a schematic diagram of a link mechanism and, in particular, a cross-slider crank mechanism 9. Here, the housing 2 forms the coupler of the link mechanism. A first thrust link 10, 14 is formed by a first groove block 10 and a first groove 14, and a second thrust link 12, 15 is formed by a second groove block 12 and a second groove 15. The coupler and the housing 2 forming it, respectively, is rotatably connected via the rotary links 10.1, 12.1 to the thrust links 10, 14; 12, 15. The links 12, 12.1, 15; 10, 10.1, 14 can also be formed as rotary and thrust links. A thrusting movement of the first thrust link 10, 14 necessarily results in a thrusting movement of the second thrust link 12, 15 and a rotational movement of the housing 2, which forms the coupler. The angle β between the thrust directions 17 and 18 may be other than 90° (i.e., oblique-angled). The angle is preferably 90° (right-angled) in the case of groove blocks 10, 12 that are guided perpendicularly to one another.

Figure 8:
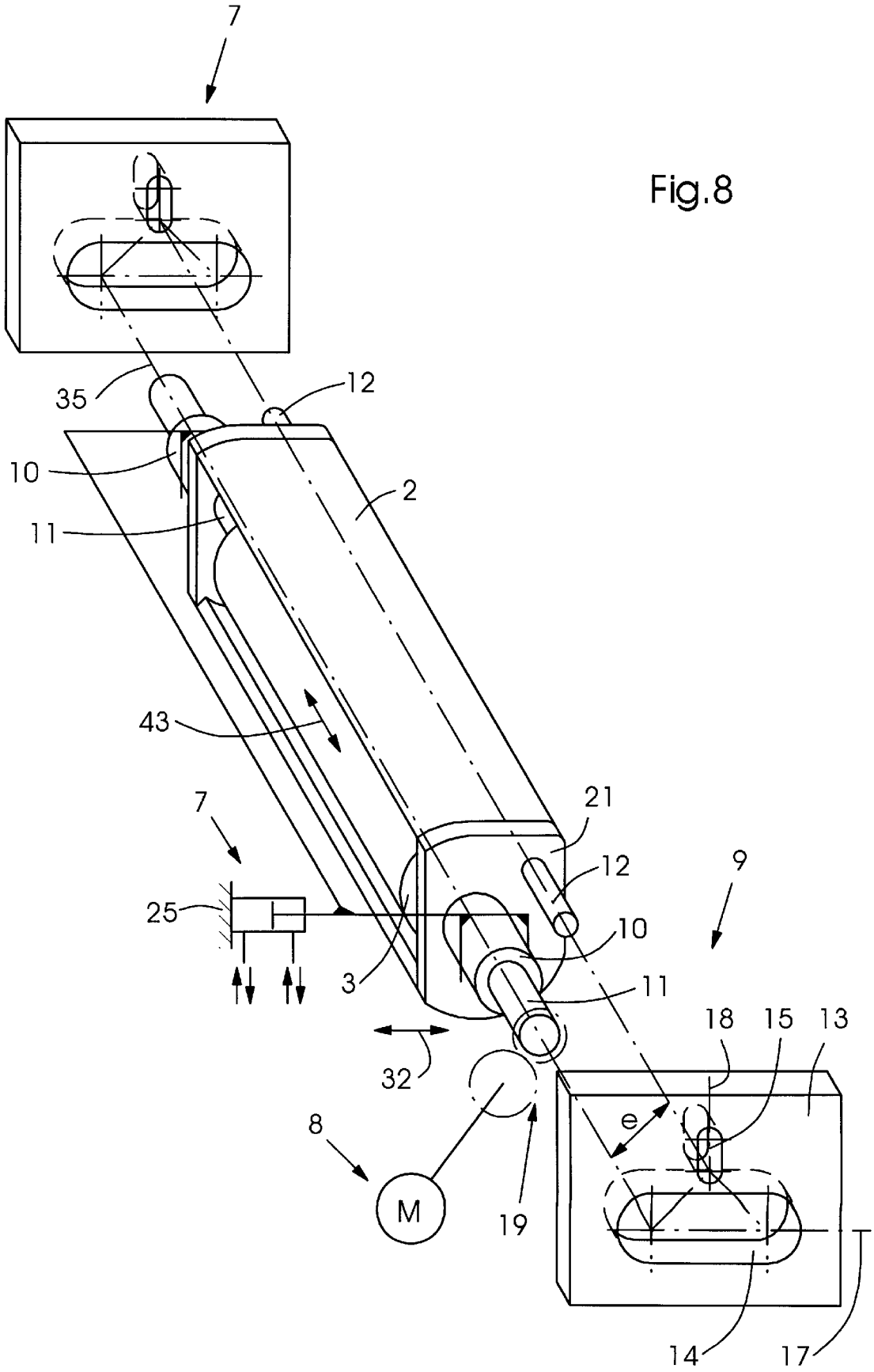
FIG. 8 is an exploded perspective view of the embodiment of the cleaning device according to the invention shown in FIGS. 5 and 6.

In FIG. 8, the housing 2, together with the cleaner 3 arranged therein, as well as the device 7, 9, which moves the housing 2 relative to the non-illustrated covering, in particular the trough, and belongs to the cleaning device embodiments of FIGS. 2 to 6 are illustrated using the example of the cleaning device embodiment of FIGS. 5 and 6. The device 7, 9 includes an actuating drive 7, which brings the cleaner 3, together with the housing 2, into and out of contact with the non-illustrated cylinder, as well as two gear transmission mechanisms 9. The gear transmission mechanisms are in correspondence with the principle illustrated in FIG. 7. The actuating drive 7 may be an electric motor or a hydraulic cylinder. A pneumatic cylinder is preferably used in the embodiment of FIG. 8, and may be of double-acting construction, i.e., it may be actuated pneumatically in both directions. The actuating drive 7 acts upon at least one of the two first groove blocks 10, which are formed as housing journals. The first groove block 10 may be enclosed by a bushing or the illustrated fork and may be rotatable in the enclosure. In addition to the actuating drive 7, a further drive 8, which operates independently of the printing press drive and may be formed as an electric motor, is provided. The cleaner 3 is driven rotatively by the drive 8, for example via a gear transmission mechanism 19. The lateral oscillating movement 43 of the cleaner 3 can also be effected by the drive 8 via a further non-illustrated gear transmission mechanism. Arranged on one side, or preferably on both sides, of the housing 2 is the cross-slider crank mechanism 9, which belongs to the device 7, 9. In addition, it is also possible for the gear transmission mechanism to be configured as some other type of gear transmission mechanism. The fixed arrangement of a pinion on the housing journal 10 would be possible. The pinion is able to roll on a rack, meshing with the latter, so that the housing is made to rotate by the rack and pinion gear mechanism during displacement into and out of contact with the cylinder. The grooved cam gear mechanism illustrated is particularly beneficial in terms of its construction. The groove blocks 10, 12 are fastened to the housing 2. The groove blocks 10, 12 may be formed other than round, for example cuboidal or as T-groove blocks, and rotatably mounted in the housing 2. In the case of the preferred embodiment shown in FIG. 8, the groove blocks 10 and 12 are formed round, i.e., so as to have a circular cross section. The first groove block 10 forms both the housing journal and a bushing through which the cleaner journal pin 11, which is mounted in the latter, extends. The first groove block 10 is arranged on the housing 2 and encloses the journal pin 11 which forms the axis of rotation of the cleaner 3. In this manner, the cleaner 3 and the housing 2 are mounted coaxially. The first groove block 10 and the cleaner 3 or the journal pin 11 thereof may also be mounted on mutually offset rotational or pivoting axes. The second groove block 12 is formed as a bolt. The groove blocks 10 and 12 may be formed as sliding blocks, as shown, or as rollers. The groove blocks 10 and 12 are arranged so that they are offset a distance e from one another, the second groove block 12 being arranged to be off center by the distance e with respect to the axis of rotation of the housing 2. The arrangement of the groove blocks 10, 12 and the grooves 14 and 15 with respect to the housing 2 or with respect to the frame 13 can be performed in different ways, respectively, two elements, two grooves or two groove blocks or one groove and one groove block, being arranged on the housing 2 and on the frame 13. The depicted arrangement of the groove blocks 10 and 12 on the housing 2 and of the grooves 14 and 15 on the frame 13 is advantageous in design terms. The grooves 14 and 15 are arranged in relation to one another so that the center lines thereof and the extension lines thereof, respectively, which correspond to the thrust directions 17 and 18, intersect at a point, in particular at right angles. In the event that one groove 14; 15 is formed in the frame 13, and the other groove 14; 15 is formed in the housing 2, for example in the side wall 21, the projections of the center lines intersect. A gear mechanism 9 formed in this manner may be arranged on one side or preferably on both sides of the housing 2. The grooves 10 and 12 may extend in a curve or may preferably be formed as rectilinear guides. The gear mechanism 9 thus includes two rotary and thrust links 10, 14; 12, 15 assigned to the housing 2, the first rotary and thrust link 10, 14 enabling displacement of the housing 2 in the direction 32 into and out of contact with the cylinder and blocking displacement perpendicular to this direction, and the second rotary and thrust link 12, 15 blocking a displacement of the housing 2 in the direction 32 into and out of contact with the cylinder and enabling displacement perpendicular to this direction. The links 10, 14; 12, 15 are arranged so that displacement of the housing 2 in a manner guided in the second link 10, 14, necessarily results in displacement of the housing 2 in a manner guided in the first link 12, 15 and, consequently, in rotation of the housing 2 about the first link 10, 14. In the example at hand, the links 10, 14; 12, 15 are formed as rotary and thrust links. The housing 2 encloses the cleaner 3 from five sides. The cleaner 3 is formed as a laterally oscillating brush roller.

Figure 9:
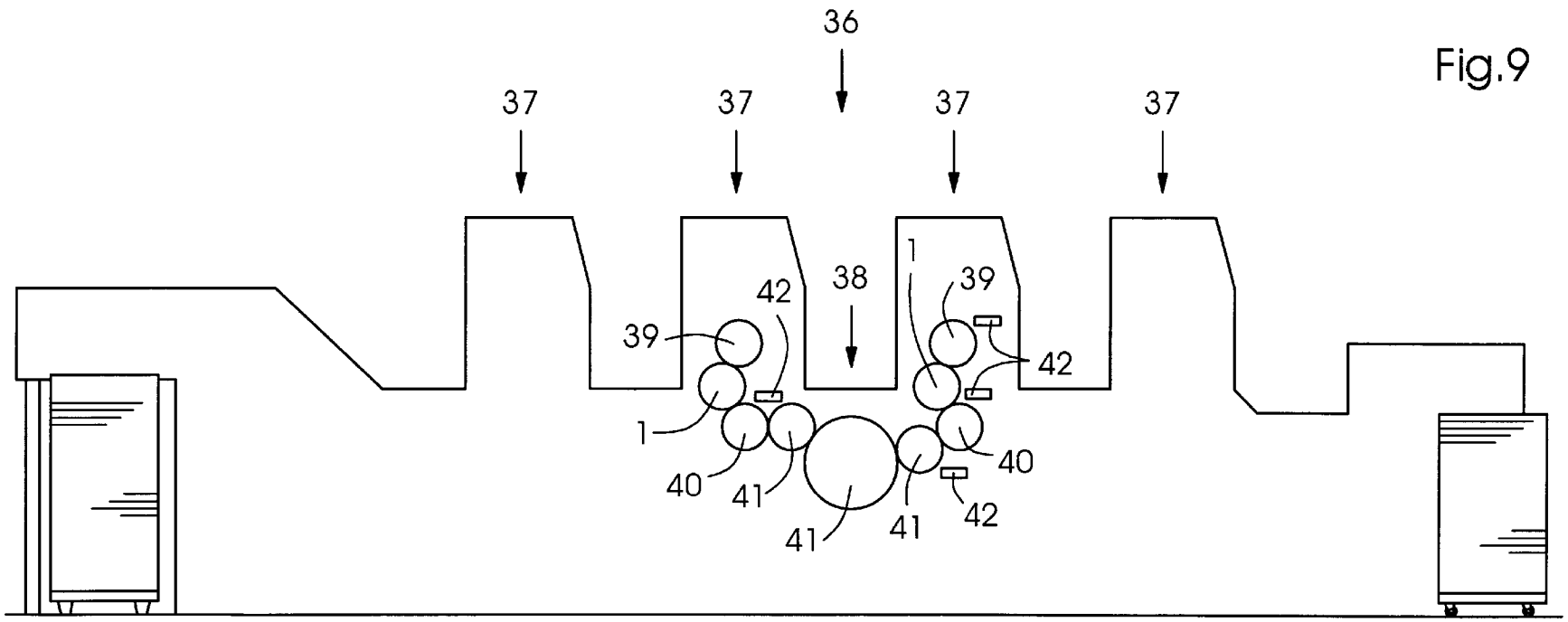
FIG. 9 is a diagrammatic side elevational view of a rotary printing press incorporating the cleaning device according to the invention.

FIG. 9 shows a sheet-fed offset printing press 36 having printing units 37 and a sheet transfer device 38, in particular a reversing device. Each printing unit 2 has a printing plate cylinder 39, a blanket cylinder 1 and an impression cylinder 40. The sheet transfer device 38 has at least one drum 41. The cleaning device 42 according to the invention may be assigned to one or more printing unit cylinders 1, 39, 40 or sheet transfer drums 41 for the purpose of cleaning them. The cleaning device is preferably assigned to a blanket cylinder 1 and/or to the impression cylinder 40 that cooperates directly with this blanket cylinder 1. A cleaning device 42 that is assigned to several cylinders 1, 40 may be formed optionally so as to be brought into contact with the cylinders 1; 40 and pivoted or swiveled against the cylinders.

I claim:

1. A device for cleaning a cylinder in a printing press, comprising:

a cleaner engageable and disengageable with a cylinder in a printing press;

a housing formed with an opening, said cleaner disposed in the housing;

a cover for covering the opening of the housing; and a closing device being actuatable for moving the housing relative to said cover so as to bring the opening of the housing into alignment with said cover.

2. The cleaning device according to claim 1, wherein the opening of the housing is directed towards the cylinder when the cleaner is in an in-contact position, and the opening is essentially directed away from the cylinder when the cleaner is in an out-of-contact position.

3. The cleaning device according to claim 2, wherein said cover is a trough disposed beneath the housing, the opening of the housing being directed towards said trough when the cleaner is in the out-of-contact position.

4. The cleaning device according to claim 3, wherein said trough is connected to the housing so that, during a movement of the housing towards and away from the cylinder, said trough is entrained by the housing.

5. The cleaning device according to claim 1, wherein the housing is formed so as to be rotatable or swivelable about an axis parallel to the axis of rotation of the cylinder.

6. The cleaning device according to claim 5, wherein the housing and the cleaner are coaxially rotatably mounted.

7. The cleaning device according to claim 1, wherein the housing opening is forcibly closed by said closing device as the cleaner moves out of contact with the cylinder, and opened as the cleaner moves into contact with the cylinder.

8. The cleaning device according to claim 7, wherein said closing device comprises a gear transmission mechanism for forcibly closing and opening the housing opening as the cleaner moves into and out of contact with the cylinder.

9. The cleaning device according to claim 8, wherein said gear transmission mechanism is a cross-slider crank mechanism.

10. The cleaning device according to claim 1, wherein the cleaner is formed as a brush roller, and including at least one cleaning element assigned to said brush roller inside the housing.

11. The cleaning device according to claim 10, wherein said cleaning element disposed inside the housing is separate therefrom.

12. The cleaning element according to claim 10, wherein said cleaning element is a combined spraying and cleaning doctor blade for penetrating into the bristles of said brush roller.

13. The cleaning device according to claim 1, in combination with a printing press.

14. The cleaning device according to claim 1, wherein the cleaner is a cleaning roller.

15. The cleaning device according to claim 5, wherein the cleaner is a roller-type cleaner having an axis of rotation, and the housing is rotatable about said axis of rotation of said roller-type cleaner.

* * * * *